US005170433A

United States Patent [19]

Elliott et al.

[11] Patent Number: 5,170,433

[45] Date of Patent: Dec. 8, 1992

[54] ACTIVE VIBRATION CONTROL

[75] Inventors: Stephen J. Elliott, Winchester; Philip A. Nelson, Southampton; Ian M. Stothers, Eastleigh, all of England

[73] Assignee: Adaptive Control Limited, Southampton, England

[21] Appl. No.: 448,517

[22] Filed: Dec. 11, 1989

Related U.S. Application Data

[63] Continuation-in-part of Ser. No. 198,137, May 24, 1988, abandoned.

[51] Int. Cl.[5] ..... G10L 3/00

[52] U.S. Cl. ..... 381/47; 381/71; 381/94; 395/2

[58] Field of Search ..... 381/46, 47, 71, 94

[56] References Cited

U.S. PATENT DOCUMENTS

| | | | |
|---|---|---|---|
| 4,153,815 | 5/1979 | Chaplin | 381/71 |
| 4,417,098 | 11/1983 | Chaplin et al. | 381/94 |
| 4,473,906 | 9/1984 | Waranaka et al. . | |
| 4,625,083 | 11/1986 | Poikela | 381/46 |
| 4,630,304 | 12/1986 | Borth et al. | 381/47 |
| 4,683,590 | 7/1987 | Miyoshi et al. | 381/71 |
| 4,689,821 | 8/1987 | Salikuddin et al. | 381/71 |
| 4,715,559 | 12/1987 | Fuller | 381/71 |
| 4,947,356 | 8/1990 | Elliott et al. | 381/71 |

FOREIGN PATENT DOCUMENTS

| | | |
|---|---|---|
| 8200337 | 6/1983 | PCT Int'l Appl. . |
| 1577322 | 10/1980 | United Kingdom . |
| 2122052 | 1/1984 | United Kingdom . |
| 2149614 | 6/1985 | United Kingdom . |

OTHER PUBLICATIONS

Elliott, S. J. et al., Methodes Actives de Contole du Bruit et des Vibrations, Colloque Euromech 213, dated Sep. 1986. English: "A Multichannel Adaptive Algorithm . . . ".

Kido, K. et al., The Science Reports of the Research Institutes, Tohoku University, pp. 97–110, published 1971.

"Algorithm for Multichannel LMS Adaptive Filtering," Electronic Letters, vol. 21, No. 21, dated Oct. 10, 1985.

Elliott, S. J. et al., "An Adaptive Algorithm or Multichannel Active Control," Proc., I.O.A., vol. 8, Part 1, dated Mar. 25, 1986.

Widrow, B. et al., "Adaptive Signal Processing," pp. 182–192, Prentice-Hall, Inc., published 1985.

Olson H. F. et al, "Electronic Sound Absorber," The Journal of Acoustical Society of America, vol. 25, pp. 1130–1136, published Nov. 1953.

*Primary Examiner*—Michael R. Fleming
*Assistant Examiner*—David D. Knepper
*Attorney, Agent, or Firm*—Plante, Strauss & Vanderburgh

[57] ABSTRACT

To reduce noise inside a motor car passenger compartment, two loudspeakers $37_1$, $37_2$ are driven by signals derived from a reference signal x(n) by adaptive filtering carried out by a programmed microprocessor and memory unit 36 which adapts the filtering in dependence on error signals $e_i(n)$ from four microphones $42_1$, $42_2$, $42_3$ and $42_4$ distributed in the passenger compartment. Reference filtering coefficients are initially determined by analysis of finite impulse responses when white noise is acoustically coupled from the loudspeakers 37 to the microphones 42, a white noise generator 48 being coupled to the unit 36. The reference signal x(n) is restricted to one or more selected harmonics or subharmonics of the fundamental noise frequency by a filter 34 which tracks the selected frequency. The selected frequency may be obtained from a coil 31 in the ignition circuit of the vehicle.

23 Claims, 8 Drawing Sheets

FIG. 6.
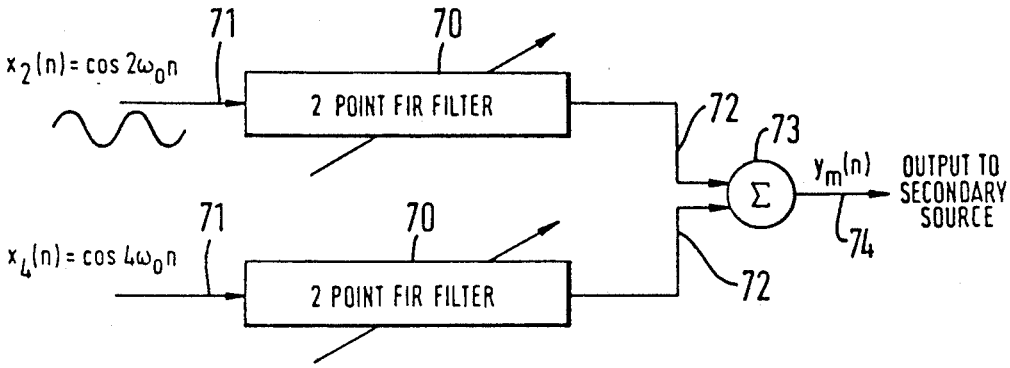
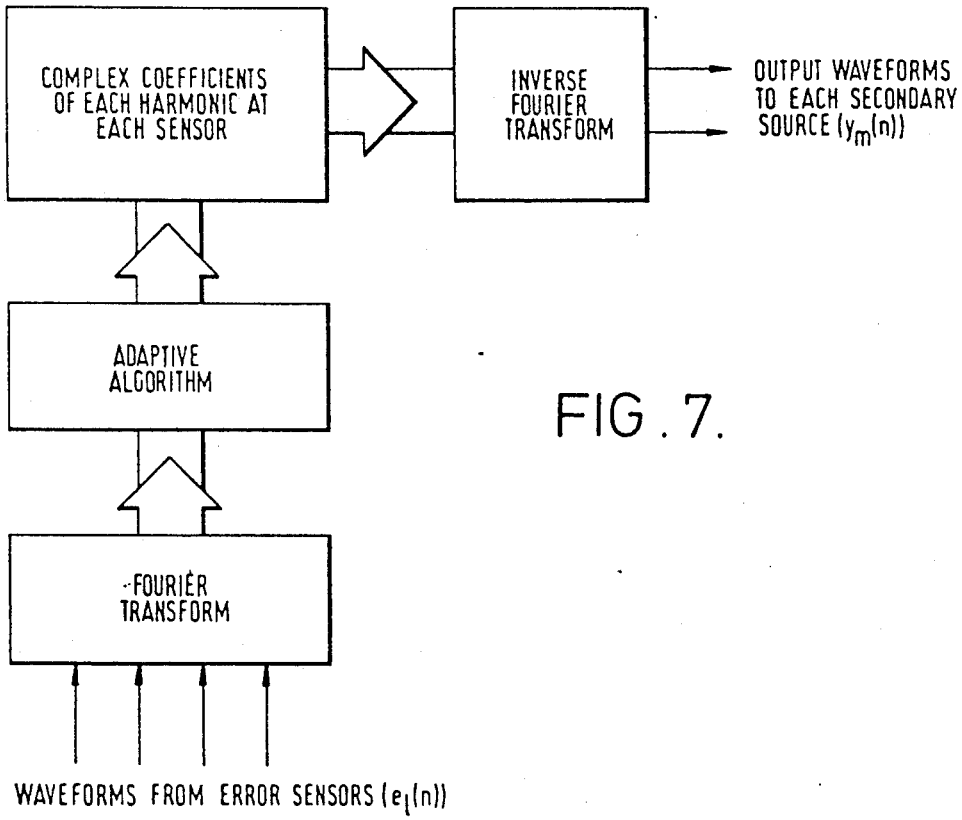
FIG. 7.

ACTIVE VIBRATION CONTROL

REFERENCE TO PENDING APPLICATION

This application is a continuation-in-part of our copending U.S. appl. Ser. No. 198,137, filed May 24, 1988, now abandoned.

BACKGROUND OF THE INVENTION

The invention relates to active vibration control.

As used herein, the term "vibration" includes sound or noise, and the invention is particularly concerned with active noise control.

In passenger compartments of cars (automobiles), where a significant noise component is harmonically related to the rotation frequency of a reciprocating engine used to drive the car, the sound levels at low frequencies in such enclosures are difficult to attenuate using conventional passive methods and can give rise to subjectively annoying "boom". A method of actively attenuating a simple sound field by introducing a single secondary sound source driven so that its output is in antiphase with the original ambient noise is described in general terms by B. Chaplin in "The Chartered Mechanical Engineer" of January 1983, at pages 41 to 47. Other discussions are to be found in an article entitled "Active Attenuation of Noise-The State of the Art" by Glenn E. Warnaka at pages 100 to 110 in Noise Control Engineering, May-June 1982 and in Internoise 83 Proceedings, pages 457 to 458 and 461 to 464, and Internoise 84 Proceedings, pages 483 to 488. Particular methods and apparatus are also described in British Patent Specification Nos. 1,577,322 and 2,149,614.

SUMMARY OF THE INVENTION

According to the present invention, an active vibration control system for reducing vibration generated by a primary source, is characterised in that at least one reference signal containing selected harmonics of the said primary source vibration is supplied to means driving a plurality of secondary vibration sources, such that vibration energy detected by sensor means operable to sense the vibration field established by the primary and secondary sources is reduced.

As used herein, the term "harmonic" includes "subharmonics".

Preferably the control system is operable in accordance with an algorithm which adjusts the outputs from the secondary sources so as to substantially reduce a cost function on a time scale comparable with the delays associated with the propagation of vibration from the secondary sources to the sensor means.

The present invention is particularly concerned with an active noise reduction system which can control the sound throughout an enclosure of a car, or at one or a number of "quiet zones" within it, and which can quickly adapt to changes in the excitation of the sound field due to changes in, for example, engine load or speed.

In order to ensure that the sound produced by the secondary vibration sources is of the same frequency as that produced by the engine, a signal related to the engine crankshaft rotation rate, for example a signal emitted by the engine ignition system, is used to generate a reference signal containing a number of sinusoids at harmonics (or subharmonics) of the engine crankshaft rotation frequency. These are known as engine order frequencies. These sinusoids may be obtained using a variety of methods outlined below. Rather than attempt to control all harmonics, only a selected set of engine order frequencies may, in accordance with the invention, be generated as the reference signal. For example, only the firing frequency (second engine order in a four cylinder car) and its second harmonic (fourth engine order) are used if the spectrum of the sound in the car is dominated by these components.

Alternatively, a signal containing all the engine order frequencies may be fed to a band pass filter which isolates only the particular frequency or frequencies exciting a particular resonance in the enclosure interior which could cause a "boom" to be excited. The advantage of reducing the number of frequencies fed to the filter is that an adaptive filter having fewer coefficients than would otherwise be the case can be used. This makes implementation more efficient and allows faster adaption time. The faster adaption time is particularly important in automotive applications, for example, in which the active control system has to adapt sufficiently quickly to track changes in engine speed which may occur on a very short timescale.

Other reference signals may be obtained from transducers mounted on a road wheel hub or the suspension system of the car. Such reference signals would contain the harmonics of road wheel rotation or road noise. Transducers placed outside a vehicle may provide reference signals representative of wind noise. Reference signals from such sources may be broad band (random), in which case these reference signals may be fed directly to adaptive filters as described hereinafter. Alternatively, if the reference signals are periodic (deterministic), control at individual harmonics can be exercised as described hereinafter.

When the enclosed space is a motor vehicle interior, the secondary sources may be loudspeakers used as the low frequency drives of a car audio system.

Examples of methods in accordance with the invention for generating the reference signals from a signal from an internal combustion engine are now discussed.

1. Selection of harmonics by filtering

A signal is obtained from the primary vibration source which contains components at all harmonics prevalent in the sound in a vehicle powered by an engine. This signal is filtered so as only to leave the most important or dominant harmonics. Filtering is carried out by a filter whose centre frequency can be controlled by an external signal in such a manner that the critical filter frequencies have a constant ratio compared with the engine crankshaft rotation rate. This can be achieved by using, for example, charge coupled devices whose switching frequency is locked to the crankshaft rotation frequency, but can also be implemented as a program running on a microprocessor, as described hereinafter.

2. Selection of harmonics within a band by fixed filtering

A primary source signal rich in harmonics is filtered by a band pass filter, having a centre frequency fixed at that of a pronounced "boom" in the car enclosure and a characteristic such that the reference signal only contains the harmonic(s) which are particularly exciting the boom. This may be extended such that the filter contains a number of resonances at a number of boom frequencies of the car, or even such that the filter has a frequency response which models the acoustic response of the car interior to the primary excitation. The input signal to the filter may be a signal from the engine containing all important harmonics and may be in the form of a pulse train.

3. Generation of specific harmonics locked to the engine crankshaft rotation frequency This method may be accomplished by using phase lock loops to generate sinusoidal signals, with frequencies bearing an integer relationship to a square wave signal from the engine, which frequencies are then added together to form the reference signal. Alternatively, the signal derived from the engine can be used to control a number of tunable oscillators, each producing a sinusoid at a selected harmonic frequency. In one arrangement employing such a bank of tunable oscillators, the period of the square wave signal at the engine rotation rate is measured with a counter passed to a microprocessor which implements a number of digital oscillators using difference equations of the form $$x_I(n)=\delta(n)+2\cos(I\omega_o)x_I(n-1)-x_I(n-2)$$

where $\omega_o=2\pi f_c/Nf_s$, I is the order of the harmonic or subharmonic to be generated, $f_c$ is the frequency o f the counter, which counts N pulses during a period, and $f_s$ is the sample rate used for the difference equation. $\delta(n)$ is a unit sample sequence to initiate the oscillators formed by the difference equations above. The second and fourth harmonic may be generated for example.

It is advantageous if the sample frequency ($f_s$) is derived from the counter frequency ($f_c$) by a frequency division circuit for example, so that the ratio $f_s/f_c$ is exactly an integer number.

An alternative difference equation which may be used to implement the digital oscillator has the form of a series approximation to a trigonometric function, for example:

$$x_I(n) = 1 - \frac{y^2}{2!} + \frac{y^4}{4!} - \frac{y^6}{6!} + \frac{y^8}{8!} \simeq \cos(y)$$

The variable y is the accumulated phase of the oscillator, given by $$y(n) = \sum_{i=0}^{n} \omega_I(n)$$

$\omega_I(n)=I\omega_o$ where $\omega_o$ is calculated from the measured period of the reference signal, as above, for every new sample (n). The series approximation above can be used for y(n) in the range $-\pi/2<y(n)<\pi/2$. For values of y(n) outside this range the symmetry properties of the cosine waveform are utilised, until $y(n)>\pi$. When $y(n)\geqq\pi$, the natural overflow properties of the two's complement number representation is used to allow y(n) to "wrap-around" to $y(n)\geqq-\pi$ and the series expansions and symmetry properties discussed above are again used. In this way the digital representation of y(n) is kept within the range $-\pi<y(n)<\pi$, and $x_I(n)$ is within the range $\pm 1$.

The calculations of the coefficients used in the difference equations forming the digital oscillators, together with the difference equations themselves may be implemented on a dedicated processor, or may form part of the program which also implements a controller that generates the outputs used to drive the secondary sources from the reference signals described above.

The controller is designed to be adaptive so as to quickly track changes in engine speed and load. The outputs of the secondary sources are adaptively controlled so that some measurable cost function is minimised. This cost function would typically be the sum of the mean square outputs from a number of microphones in the enclosed space. The controller can be implemented as a digital adaptive FIR filter, using the basic update algorithm described by S. Elliott and P. Nelson in "Electronics Letters", at pp. 979–981, 1985. A number of additions must be made to this basic algorithm, however, to enable it to work quickly and efficiently in this particular example. The basic algorithm, referred to hereinafter as the stochastic gradient algorithm, is presented below, in order to highlight the necessary alterations. If the i'th coefficient of the adaptive filter driving the m'th secondary source at sample number n is $w_{mi}(n)$, then each of these coefficients should be adjusted at every sample according to the equation $$w_{mi}(n+1) = w_{mi}(n) + \alpha \sum_{l=1}^{L} e_l(n) r_{lm}(n-1)$$

where $\alpha$ is a convergence coefficient, $e_l(n)$ is the sampled output from the l'th sensor and $r_{lm}(n)$ is a sequence formed by filtering the reference signal discussed above (x(n), say) with a digital filter which models the response of the l'th sensor to excitation of the m'th secondary source. These digital filters, generating each $r_{lm}(n)$, have only two coefficients in the implementation described in the "Electronics Letters" article, since control at only a single, fixed, frequency was being attempted. In the present example, however, the digital filters must model the relevant response over a range of frequencies, governed by the frequency range which the active system is attempting to control. It has been found that under certain circumstances a digital filter need only model the overall delay in the response to ensure the stability of an adaptive filter. It is more common, however, to have the digital filters incorporate a delay and then some reverberant response. This may be implemented using either digital FIR or IIR filters whose coefficients are adjusted adaptively during an initialisation phase, so as to accurately match the desired responses. It is also possible to continue this initial adaption process during the operation of the active control system by feeding training signals to each secondary source which are suitably uncorrelated with each other and with the primary excitation. This may be necessary to track changes in the acoustic response of the enclosure. Alternatively, if the change is due to some well-defined cause, such as a passenger sitting down or a car window being opened, this change may be detected with mechanical transducers and the information used to switch between a cariety of filters modelling the response of the enclosure under a variety of conditions.

Another important consideration concerning the use of adaptive algorithm in this example concerns the effect of unwanted, low level, harmonic or subharmonic components in the reference signal. Suppose that the method used to generate the reference signal, as described above, is designed to produce only I frequencies. Even though there may only be I desired harmonics in such a system, there will in practice also be a number of other harmonics or subharmonic frequencies at low level, because of the finite cut-off rate of the filters, for example. These components may also be being generated by the primary source and therefore present in the enclosure and hence at the outputs of sensors such as microphones and thus the adaptive algorithm will attempt to cancel them by enormously amplifying the low level, spurious harmonic reference signals. This can cause numerical overflow problems in the adaptive filter coefficients. This may be prevented in a number of ways:

(1) The use of only 2.I coefficients in the adaptive filter.

(2) The deliberate injection of random noise into the reference signal.

(3) The insertion of a "leak" into the algorithm so that, in the equation above, the past coefficient value, $w_{mi}(n)$, is multiplied by a factor close to but not equal to unity before being updated.

(4) The addition of an extra term in the update equation which minimises a cost function involving "effort" as well as "error", as described in ISVR Technical Report No. 136, 1985, published by the Institute of Sound and Vibration Research, University of Southampton.

A number of other adaptive algorithms may also be implemented to adjust the coefficients of the digital filters in the controller driving the secondary sources. These alternative algorithms are best described in matrix form.

Assuming the availability of a sampled reference signal, x(n), which is correlated with the output of the primary source, but is unaffected by the action of the secondary sources. The output to the m'th secondary sources, $y_m(n)$, may be obtained by passing this reference signal through a digital filter whose i'th coefficient is $w_{mi}(n)$ at the n'th sample, so that $$y_m(n) = \sum_{i=0}^{I-1} w_{mi}(n)x(n-i)$$

The sampled output from the l'th error sensor, $e_l(n)$, is equal to the sum of the contributions from the primary source, $d_l(n)$, and each of the secondary sources. The response of the path between the m'th secondary source and l'th error sensor is modelled as a J'th order FIR filter with coefficients $c_{lmj}$ so that $$e_l(n) = d_l(n) + \sum_{m=1}^{M} \sum_{j=0}^{J-1} c_{lmj} y_m(n-j)$$

Therefore $$e_l(n) = d_l(n) + \sum_{m=1}^{M} \sum_{j=o}^{J-1} c_{lmj} \sum_{i=0}^{I-1} w_{mi}(n-j)x(n-i-j)$$

In order to obtain a matrix expression for the error surface we must now make the assumption that the filter coefficients in the controller are time invariant, i.e. the controller only adapts very slowly compared to the time scale of the response of the system to be controlled. Then $w_{mi}(n-j)=w_{mi}$ and $$e_l(n) = d_l(n) + \sum_{m=1}^{M} \sum_{j=0}^{J-1} \sum_{i=0}^{I-1} c_{lmj} w_{mi} x(n-i-j)$$

-continued

If we let $$r_{lm}(n) = \sum_{j=0}^{J-1} c_{lmj} x(n-j)$$

where the sequences $r_{lm}(n)$ for each l and m are called the filtered reference signals, then $$e_l(n) = d_l(n) + \sum_{m=1}^{M} \sum_{i=0}^{I-1} w_{mi} r_{lm}(n-i)$$

or $$e_l(n) = d_l(n) + r_l^T(n)w$$

where $$r_l^T(n) = \begin{bmatrix} r_{l1}(n)\ r_{l1}(n-1) \ldots r_{l1}(n-I+1) & r_{l2}(n) \ldots r_{l2}(n-I+1) \\ r_{l3}(n) \ldots & r_{lM}(n) \ldots r_{lM}(n-I+1) \end{bmatrix}$$

$$w^T = \begin{bmatrix} w_{10}\ w_{11}\ w_{1I-1} & w_{20} & w_{2I-1} \\ w_{30} \ldots & w_{M0} & w_{MI-1} \end{bmatrix}$$

So if $$e^T(n) = [e_1(n)\ e_2(n) \ldots e_L(n)]$$

$$d^T(n) = [d_1(n)\ d_2(n) \ldots d_L(n)]$$

then $$e(n) = d(n) + R(n)w$$

where $$R^T(n) = [r_1(n)\ r_2(n) \ldots r_L(n)]$$

If the cost function is written as $$J = E\left(\sum_{l=1}^{L} e_l^2(n)\right) = E[e^T(n)e(n)]$$

where E is the expectation operator, then $$J = E(d^T(n)d(n)) + 2w^T E(R^T(n)d(n)) + w^T E(R^T(n)R(n))w$$

Using the standard theory of matrix quadratic forms, the minimum of J, $J_{min}$, is obtained with $$w_{opt} = -A^{-1}b = -E(R^T(n)R(n))^{-1}E(R^T(n)d(n))$$

giving $$\begin{aligned} J_{min} &= c - b^T A^{-1} b \\ &= E(d^T(n)d(n)) - \\ &\quad E(d^T(n)R(n))E(R^T(n)R(n))^{-1}E(R^T(n)d(n)) \end{aligned}$$

The true gradient may be written $$\frac{\partial J}{\partial w} = 2E(R^T(n)d(n) + R^T(n)R(n)w(n))$$

$$\therefore \frac{\partial J}{\partial w} = 2E(R^T(n)e(n))$$

The time domain steepest descent algorithm may thus be written as $$w_{k+1} = w_k - 2\,\mu E(R^T(n)\,e(n))$$

In a practical implementation the true expectation could be approximated by an MA or AR averaging process. Alternatively, the instantaneous gradient could be used to update each filter coefficient every sample, as in the time domain "stochastic gradient" algorithm $$w(n+1) = w(n) - 2\mu R^T(n)e(n),$$

which is the matrix representation of the algorithm described above. It is clear from this formulation that the stability and convergence properties of this algorithm, in the limit of slow adaption, are governed by the eigenvalue spread of the matrix $E(R^T(n)\ R(m))$. This matrix depends only on the response of the system to be controlled, the positioning of the sources and sensors within that system and the spectral properties of the reference signal, x(n). It is possible that an unfortunate placing of these sources and sensors could cause this matrix to become ill conditioned, so that it has a large eigenvalue spread. This would create very slow "modes" in the convergence properties of such an algorithm.

This problem could be removed by using a Newton's method algorithm, the exact form of which may be written as $$w_{k+1} = w_k - 2\mu E([R^T(n)R(n)])^{-1}E(R^T(n)e(n))$$

Again, various types of averaging could be used to give a practical approximation to the expectation operator. It should be noted however that the time-independent matrix $E(R^T(n)\ R(n))$ depends only on the response of the system to be controlled and on the reference signal, and these are assumed to be known and stationary. This suggests a variety of stochastic Newton's method ("SNM") algorithms. The most obvious of these uses a modified or "normalised" set of reference signals Q(n), such that $$E([R^T(n)R(n)])^{-1}R^T(n) = Q^T(n).$$

The computation of each of these reference signals will take somewhat longer than for R(n) alone since none of the elements of Q (n) are necessarily time delayed versions of any other elements. The complete SNM algorithm, again using instantaneous versions of $E(R^T(n)\ e(n))$, becomes $$w_{n+1} = w_n - 2\mu Q^T(n)e(n).$$

BRIEF DESCRIPTION OF THE DRAWINGS

Embodiments of the invention will now be described, by way of example only, with reference to the accompanying drawings, wherein:

FIG. 6 is a block diagram illustrating how two reference signals are combined, FIG. 7 is a flow chart illustrating processing in a particular embodiment of the invention.

DETAILED DESCRIPTION OF THE PREFERRED EMBODIMENTS

Figure 1:
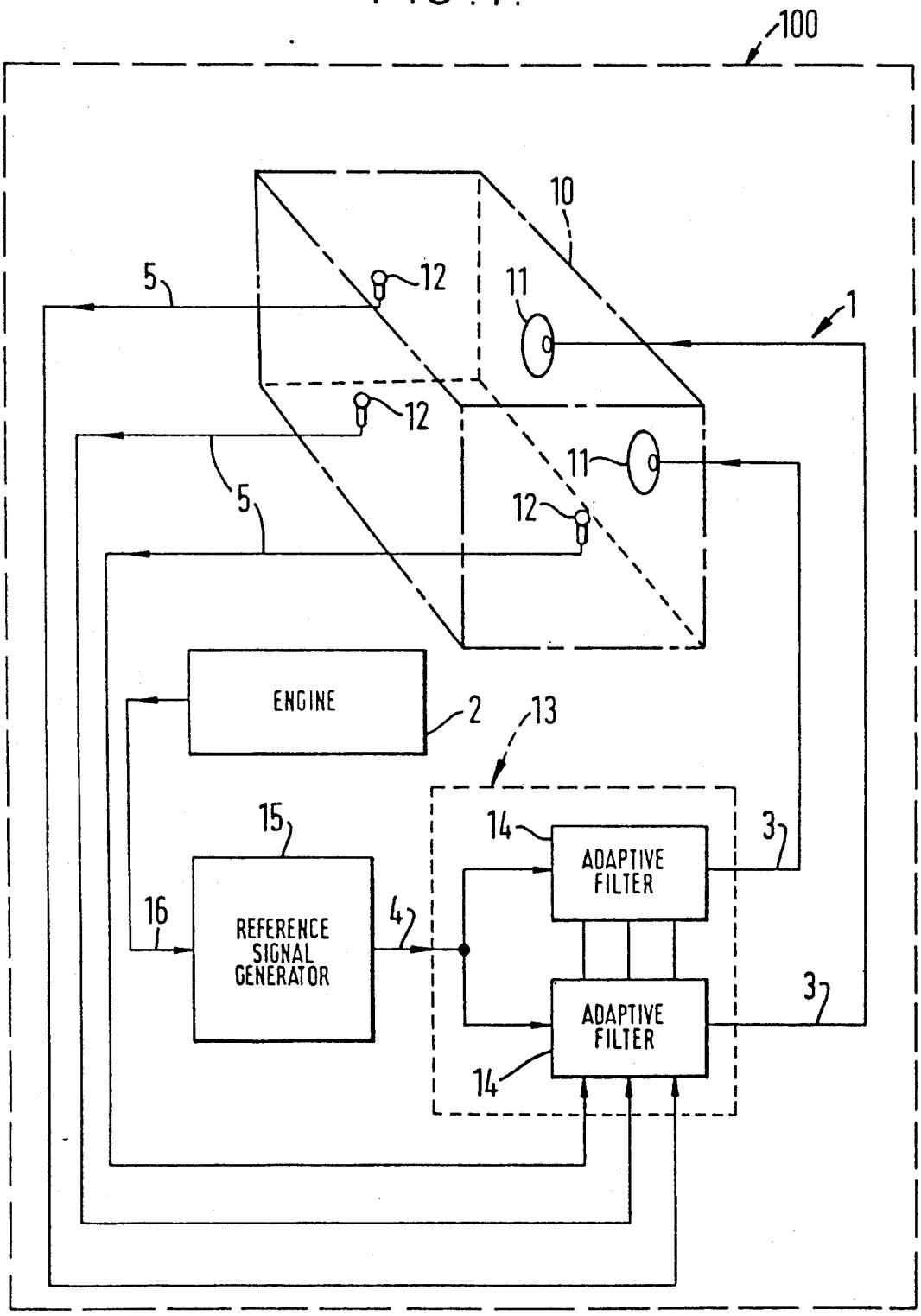
FIGS. 1 and 1(*a*) are block schematic diagrams of active noise control systems associated with an enclosed space, FIGS. 2(*a*), (*b*) and (*c*) are graphical representations of the behaviour of an element of the system of FIG. 1.

In FIG. 1 an enclosure 10, which is the interior of the passenger or driver compartment of an internal combustion engine driven vehicle, in this example, a motor car 100, is represented schematically together with an active sound control system 1 according to the invention. In this example, the system 1 employs two secondary sound sources 11, comprising two low frequency loudspeakers of a stereo audio system fitted to the car, and three acoustic sensors, comprising microphones 12. The loud-speakers 11 are driven by a controller circuit 13 which comprises a pair of adaptive filters 14. Each adaptive filter 14 drives a respective one of the loudspeakers 11 with an output signal 3 which the filter 14 produces as a result of its action on a reference signal 4 supplied thereto by a reference signal generator 15. The reference signal 4 is generated by the generator 15 from an input signal 16 which is periodic at the crankshaft rotation rate of the internal combustion engine 2.

The signal generator 15 may comprise a tracking filter.

The purpose of the outputs from the loudspeakers 11 driven by the controller 13 is to reduce the sound vibration field established by the primary and secondary sources, experienced within the enclosure 10. Since the primary source (engine 2) of the noise to be reduced is periodic, the reference signal 4 generated by the generator 15 is, in accordance with the invention, arranged to contain one or more sinusoidal components at harmonics (or subharmonics) of the crankshaft rotation rate of the engine 2. The adaptive filters 14 are adjusted automatically by output signals 5 from the sensor-microphones 12, corresponding adjustment being made simultaneously to the outputs of the loudspeakers 11 so as to substantially minimise a cost function on a time scale comparable with the delays associated with the propagation of sound vibrations from the loudspeakers 11 to the microphones 12. The cost function may comprise the sum of the mean square outputs of the microphones 12.

A decision is made beforehand as to what harmonics are to be selected; a decision which may vary from car to car.

The control system 1 does not employ a stored solution. Instead, it makes use of a plurality of closed loops, each loop comprising a microphone 12, the controller 13, and a loudspeaker 11, whereby signals from the microphone 12 are used to adapt the filters 14 controlling the loudspeaker 11, which has an influence on the output of the microphone as a result of acoustic response within the enclosure 10.

Each loop is accounted for by part of an algorithm which adjusts the outputs of the loudspeakers 11 as aforesaid, the algorithm being of the form:

$$w(n+1)=w(n)-2\mu R^T(n)e(n).$$

It will be noted that the loudspeakers 11 and the microphones 12 are distributed in the enclosure 10 in spaced relationship. The distribution, which varies from car to car, is adjusted to get substantial sound reductions throughout the enclosure 10.

It will also be noted that the system 1 employs as many closed loops as the number of sensors (12) multiplied by the number of secondary sources (11).

The manner in which each secondary source 11 effects every one of the sensors 12 is reflected in the algorithms referred to herein.

Furthermore, the system 1 employs more sensors (12) than secondary sources (11), whereby a controlled reduction of primary source vibration is achieved. This contrasts with presently-known systems employing the same number of secondary sources as sensors, whereby near perfect cancellation can be achieved at the sensor locations but vibration levels away from these locations are increased.

Since the reference signal 4 contains harmonics of the input signal 16, which signal is periodic at the engine crankshaft rotation rate, the reference signal 4 contains engine order frequencies. The signal generator 15 is arranged to select engine order frequencies that ensure that the sound produced by the loudspeakers 11 is of the same frequency or frequencies as the sound produced in the enclosure 10 by the engine 2, even during changes in engine conditions such as load or speed. The number of engine order frequencies in the reference signal 4 is restricted so that the adaptive filters 14 have a relatively small number of coefficients and can therefore adapt quickly.

All the coefficients are constantly being updated by the system, on a sample by sample basis. Thus there is no waiting for a final response before making another adjustment. The sample time is only a small fraction of the fundamental frequency of the primary source 2.

As discussed previously, the control system 1 of FIG. 1 makes use of a plurality of closed loops and each loop is accounted for by part of an algorithm of the form:

$$w(n+1)=w(n)-2\mu R^T(n)e(n)$$

With this algorithm, or with other algorithms set out hereinafter, the updated version of a particular filter coefficient is computed from the last version of that coefficient, and the calculation is not based on changes in the other coefficients of the filter which, indeed, are being updated independently by other parts of the algorithm. The different parts of such an algorithm can then be implemented in physically separate controllers, as indicated in the modified control system 1 of FIG. 1*a*.

Figure 1A:
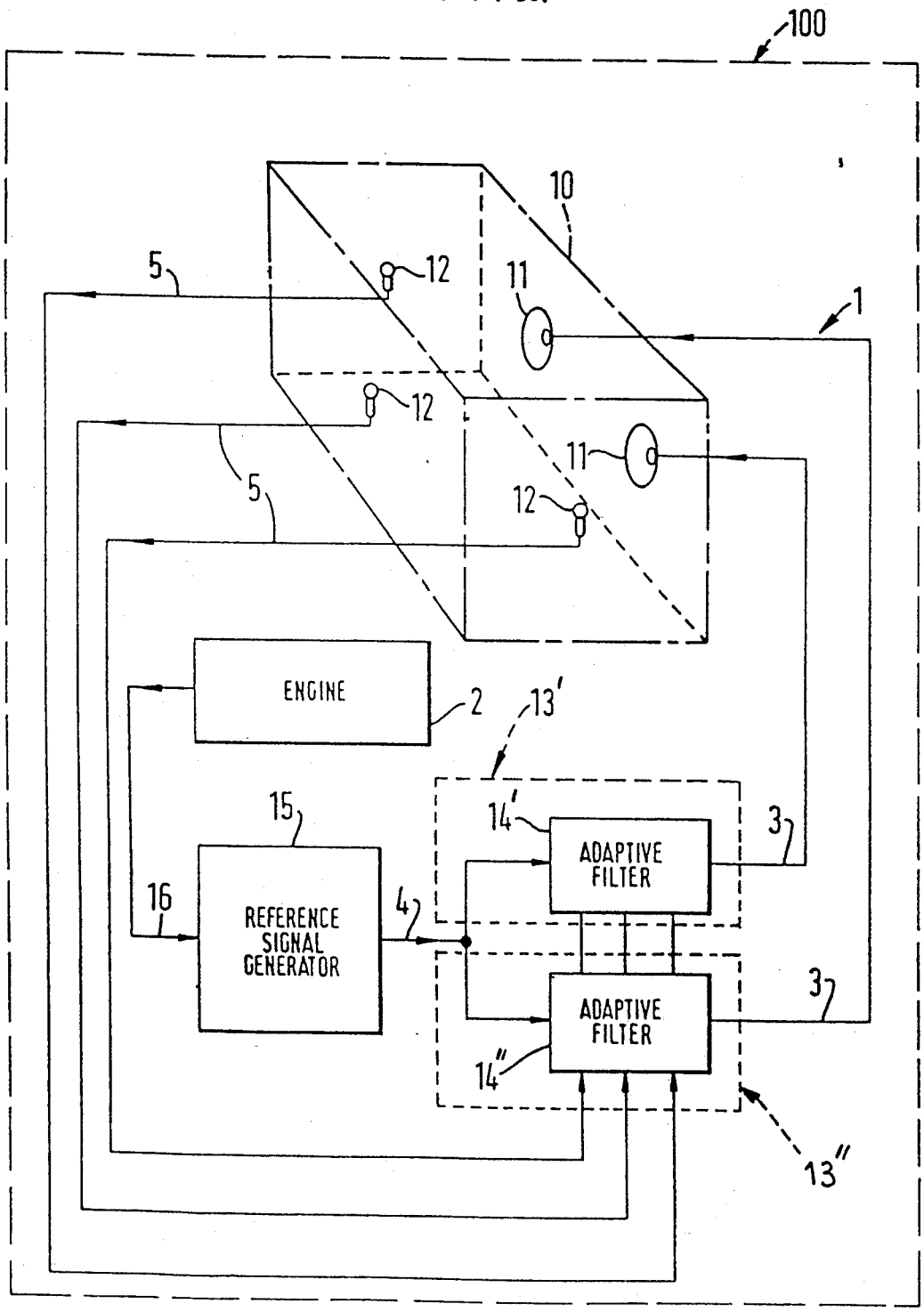

In FIG. 1*a*, physically separate controllers $13^1$, $13^{11}$ are arranged to implement parts of the algorithm which relate to updating of the coefficients of the respective adaptive filters $14^1$, $14^{11}$.

The ability to employ physically separate controllers $13^1$, $13^{11}$ can be of value in some situations, such as the control of aircraft passenger cabin noise. The complete control system can then be built up from standard modules.

For maximum speed of adaption each of the separate control modules $13^1$, $13^{11}$, etc, would be arranged to receive signals from all of the microphones 12 but this may involve a large number of connections which can be unacceptable in some situations. If some loss of adaption speed can be tolerated, then each of the control modules may be connected to only some of the microphones. Thus, at least some microphones may be shared between some of the control modules or, in the extreme, control modules may be connected to different microphones, or different sets of microphones.

The input signal 16 can be obtained from another moving part of the engine or part of the ignition circuitry; for example.

Figure 2A:
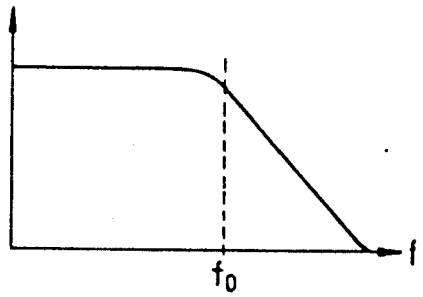
Figure 2B:
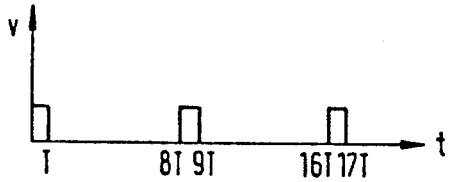
Figure 2C:
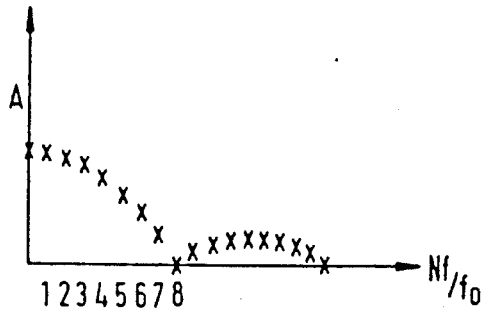

FIG. 2(*a*) illustrates graphically the response of the reference signal generator 15 when in the form of a tracking filter. That is to say, a filter having a centre frequency so controlled that the filter output frequencies have a constant ratio to the dominant input frequencies, so that in FIG. 2(*a*), the frequency $f_o$ is N×(engine crankshaft rotation rate), and the reference signal 4 (FIG. 1) contains only the first N harmonics of the engine rotation rate, where N is an integer. If the filter input signal is a voltage pulse train as represented by FIG. 2(*b*), where 8T is the periodic time of the engine rotation rate, the first eight harmonics of the engine rotation rate are present in the reference signal 4. The spectrum, by Fourier analysis, of the reference signal 4 is then illustrated by FIG. 2(*c*), in which A is amplitude. With the response of FIG. 2(*a*), only the first six harmonics would be usable.

The tracking filter comprising the signal generator, can be in the form of charge coupled devices having a switching frequency locked to the engine crankshaft rotation rate.

Figure 3:
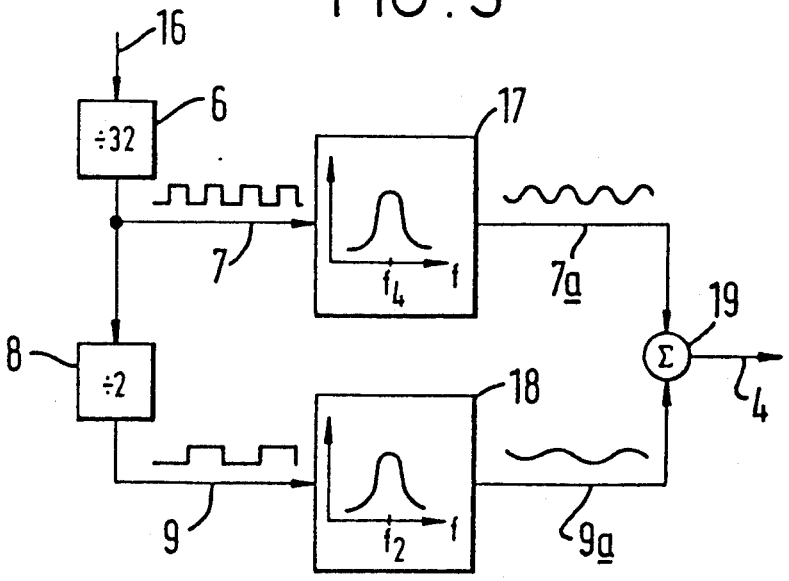
FIG. 3 is a block diagram of one form of reference signal generator.

An alternative form of reference signal generator, which employs a plurality of tracking band pass filters is illustrated by FIG. 3 in which the input signal 16, a square wave at, for example, 128 times the engine drive shaft rotation rate, is divided first by 32 and then by 2. Division by 32 is achieved by a divider 6 which produces a square wave signal 7 at four times the engine crank-shaft rotation rate, which signal is supplied to a bandpass filter 17. The filter 17 has a centre frequency $f_4$ which is arranged to track the fundamental frequency of the square wave signal 7 supplied thereto. The further division by 2 is achieved by a divider 8 which produces a square wave signal 9 at twice the engine drive shaft rotation rate. The signal 9 is then supplied to a bandpass filter 18 having a centre frequency $f_2$ and which is arranged to track the fundamental frequency of the square wave signal 9 supplied thereto. The bandpass filters 17 and 18 produce respectively sinusoidal output signals 7*a*, 9*a* at $f_2$ and $f_4$ which are linearly summed at an adder 19 to produce the required reference signal 4.

Further dividers and tracking bandpass filters can, of course, be incorporated in the circuit of FIG. 3 so that the reference signal 4 contains the desired set of engine order frequencies.

Another form of reference signal generator may comprise a fixed frequency filtering circuit which selects harmonics and/or subharmonics from an input signal rich in the harmonics of the engine crankshaft rotation rate or firing rate. The filtering circuit may comprise a bandpass filter having a centre frequency fixed at the frequency of a pronounced resonance excited in the enclosure 10 (FIG. 1) by the engine 2 or other primary source of vibration. For example, a bandpass filter may be arranged to have a response that models the acoustic response of a motor car passenger compartment to the engine.

A further form of reference signal generator may comprise a plurality of phase lock loops used to generate sinusoidal signals having respective frequencies with integer relationships to a square wave input signal from the engine 2 or other primary vibration source. The sinusoidal signals may then be added together to form the required reference signal. Thus a reference signal 4 comprising specific harmonics and/or harmonics locked to the primary source fundamental, such as engine crankshaft rotation rate, is generated.

Figure 4:
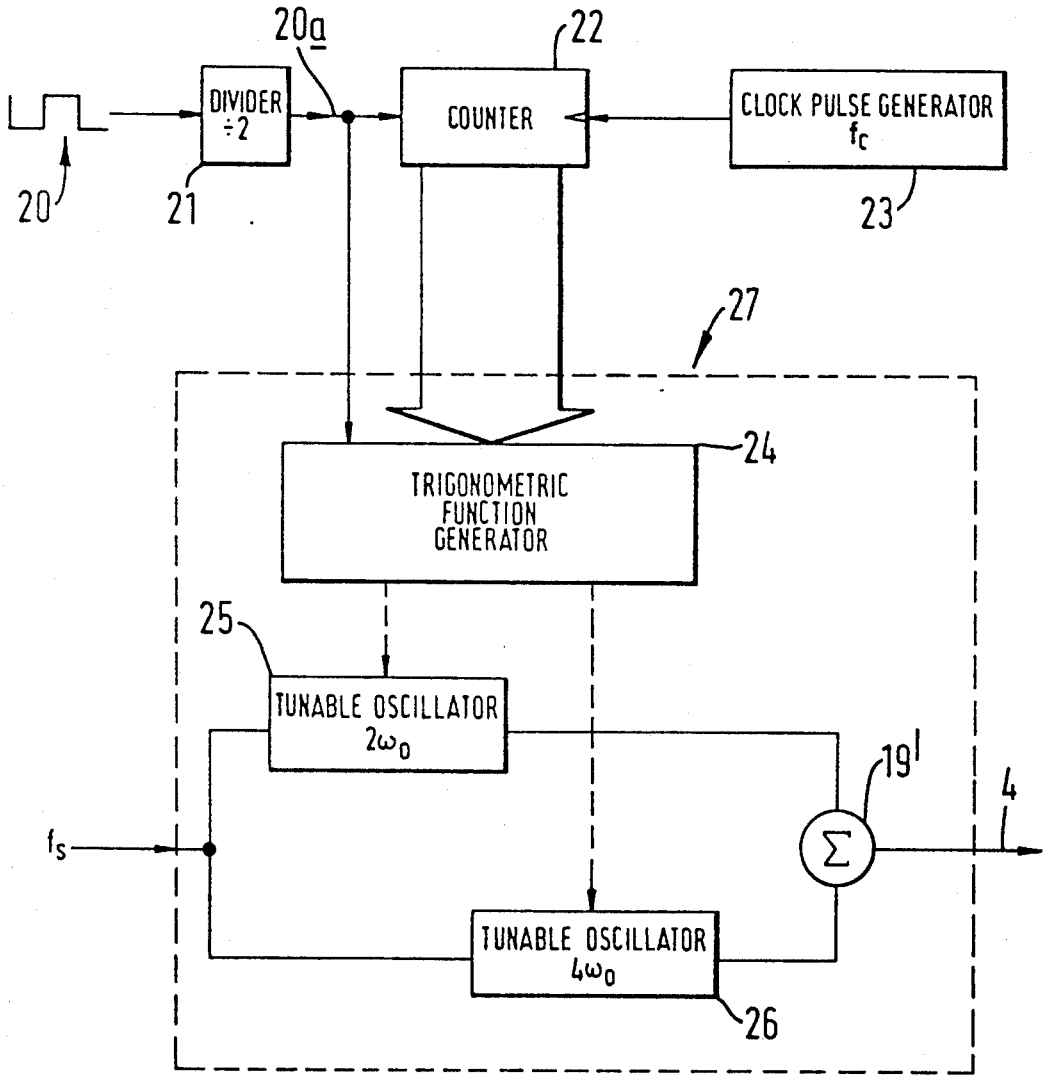
FIG. 4 is a block diagram of another form of reference signal generator.

An alternative generator for such a reference signal is illustrated in FIG. 4 in which a square wave 20 at the primary source fundamental is used to control a plurality of tunable digital oscillators 25, 26 each producing a sinusoidal signal at a chosen harmonic or subharmonic frequency to be added at the adder 19 which produce the reference signal 4 by simple addition of the sinusoidal signals.

In the signal generator 27 of FIG. 4, the square wave signal 20, which is at an engine crankshaft rotation rate, is supplied to a bistable circuit 21 which divides the rate signal by two and thereby produces a pulse train signal 20*a* in which the duration of each pulse is equal to the prevailing periodic time of the square wave signal 20. This periodic time is then measured by a counter 22 which is enabled throughout the duration of each positive pulse from the bistable circuit 21 and counts clock pulses supplied by a clock pulse generator 23. The clock pulses are generated at a fixed, suitably high rate fc.

The contents of the counter 22 are read at the end of each positive pulse from the bistable circuit 21 by a trigonometric function generator 24. The generator 24 is triggered by the trailing pulse of each positive pulse from the circuit 21 and generates two digital outputs representing respectively $\cos(2\omega_0)$ and $\cos(4\omega_0)$ where $\omega_0$ is given by $$\omega_0 = 2\pi f_c / N f_s$$

in which N is the number of clock pulses counted by the counter 22 in the duration of one positive pulse from the circuit 21, and $f_s$ is a sample rate used in the two digital oscillators 25 and 26 which receive respectively the digital outputs $\cos(2\omega_0)$ and $\cos(4\omega_0)$ from the function generator 24. The digital sinusoidal outputs from the two oscillators 25 and 26 are superposed by a digital adder 19[1] which supplies the reference signal 4 as a digital signal. The trigonometric function generator 24, oscillators 25 and 26 and adder 19[1] can be implemented by a microprocessor with a suitable program. The microprocessor can be used to produce the reference signal 4 in the form:

$$x_f(n) = \delta(n) + 2\cos(I^{\omega}{}_0)x_f(n-1) - x_f(n-2)$$

where I is the order of the harmonic or subharmonic being generated, $\delta(n)$ is a unit sample sequence which initiates the simulation of the oscillator, and n is the sample number.

Figure 5:
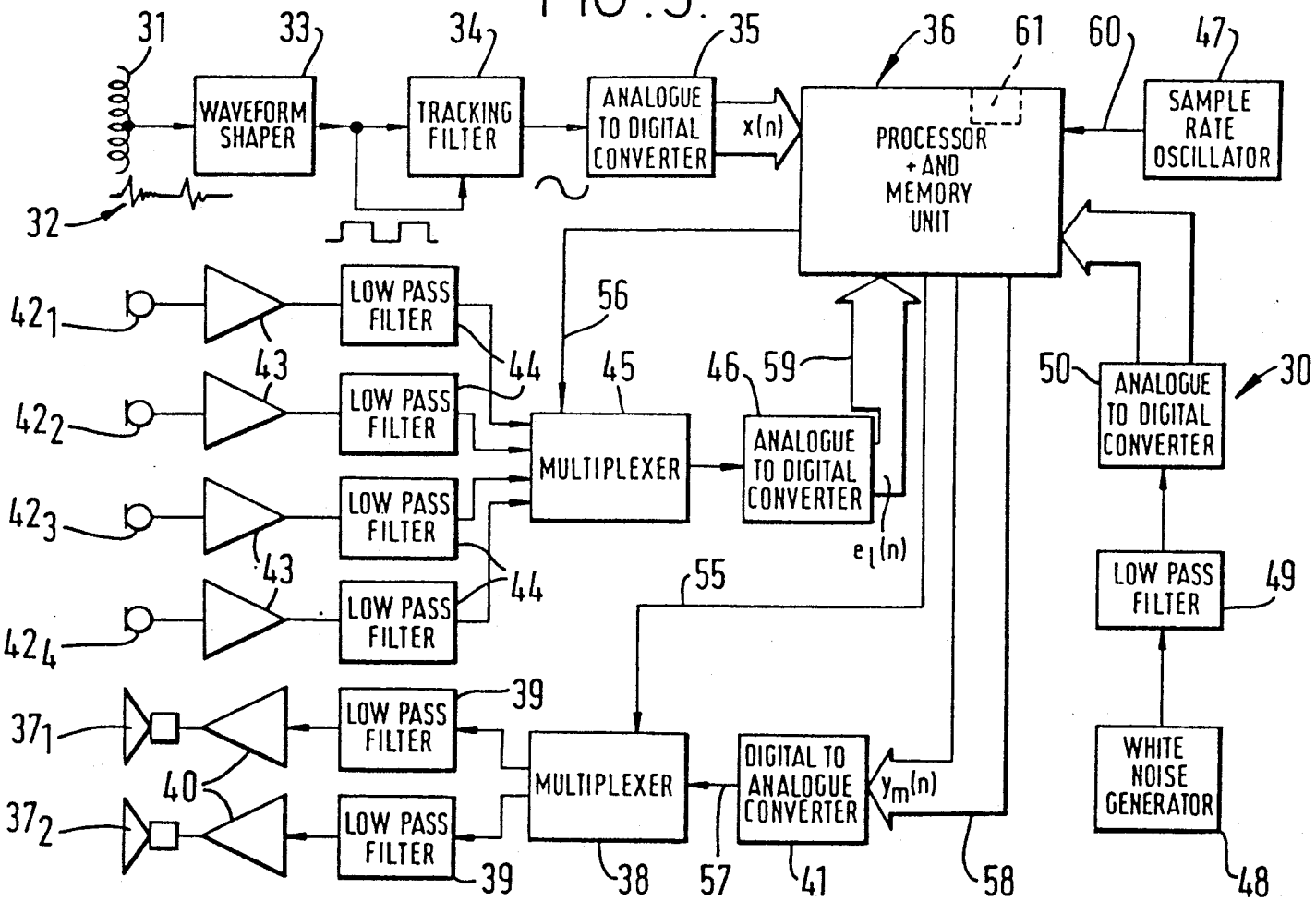
FIG. 5 is a block diagram of a circuit which incorporates a microprocessor.

FIG. 5 represents in block form an active sound control system 30 for reducing the level of engine generated noise in the passenger compartment of a motor car. The car is provided with an ignition circuit including a low tension coil 31 from which a voltage signal 32 at the firing rate of the engine is taken and supplied to a waveform shaper 33 which in response thereto produces a pulse train at the engine firing rate. It is assumed in the present example that the engine firing rate is twice the engine crankshaft rotation rate $f_o$. Thus the shaper 33 provides a signal having a fundamental frequency which is a single harmonic, $(2f_0)$, of the crankshaft rate. A reference signal generator is provided in the form of a proprietory tracking filter 34, manufactured by Bruel and Kjaer under type number 1623. The tracking filter 34 receives the output of the shaper 33 as an input signal and as a trigger signal and produces a sinusoidal output signal at the selected harmonic $2f_o$. This sinusoidal signal is sampled with an analog to digital converter 35 to produce a reference sequence x(n) of digitised samples which are supplied as data to a processor and memory unit 36.

Mounted within the motor car passenger compartment 10 (not shown in FIG. 5) are two loudspeakers $37_1$ and $37_2$, which are in positions normally used for car stereo reproduction. The loudspeakers $37_1$, $37_2$ are driven by a multiplexer 38 through respective low pass filters 39 and output amplifiers 40. The filters 39 have a cut off frequency of 460 Hz and are provided to prevent aliasing. The multiplexer 38, which contains sample and hold circuits for each output, is controlled by the processor and memory unit 36, through a control line 55, and receives a single input signal 57 from a digital to analog converter 41. The purpose of the loudspeakers $37_1$ and $37_2$ is to generate, in the passenger compartment, audio waves that will cancel those set up directly by mechanical transmission from the engine to the compartment. The digital to analog converter 41 is supplied by the processor and memory unit 36 with output data 58 which consists of two interleaved sequences of digitised samples $y_1(n)$ and $y_2(n)$. The data 58 is converted by the converter 41 into interleaved sequences of analog samples and separated into respective sequences by the multiplexer 38 for application to the low pass filters 39. Thus, in effect, the loudspeaker $37_1$ is driven by the sequence $y_1(n)$ and the loudspeaker $37_2$ is driven by the sequence $y_2(n)$. In FIG. 5 each sequence of data 58 is represented by the expression $y_m(n)$, so that in this example m may be 1 or 2.

In order to ensure that the acoustic outputs from the loudspeakers $37_1$ and $37_2$ have the correct phase and amplitude to effect cancellation of the engine noise, error signals are picked up from the passenger compartment and utilised by the processor and memory unit 36. Acoustic error signals, if present, are sensed by four microphones $42_1$, $42_2$, $42_3$ and $42_4$, which are placed respectively either side of a driver headrest and a passenger headrest, there being only two seats in the compartment in the present example. The electrical outputs from the microphones $42_1$ etc. are respectively amplified by amplifiers 43 and passed through low pass filters 44 to a four-input multiplexer 45 which supplies a single analog output to an analog to digital converter 46. The filters 44 are provided to prevent aliasing and have a cut-off frequency of 460 Hz.

The multiplexer 45 is controlled by the processor unit 36 by way of control line 56.

The multiplexer 45 and the converter 46 convert the four filtered microphone outputs into a data stream 59 comprising four interleaved sequences of digitised samples $e_1(n)$, $e_2(n)$, $e_3(n)$ and $e_4(n)$, which correspond respectively to the filtered outputs of the microphones 42$_1$, 42$_2$, 42$_3$ and 42$_4$. In FIG. 5, each sequence is represented by e (n) so that in this example l may be 1, 2, 3 or 4.

The processor and memory unit 36 receives a square wave signal 60 at 1.2 kilohertz from a sample rate oscillator 47 which determines the rate at which the converters 35, 41 and 46 convert samples and the frame duration of processing carried out by the unit 36. Thus in the present example, the unit 36 completes its processing frame within 833 milliseconds. A crystal clock oscillator 61 with a frequency of 10 Megahertz is included in the unit 36.

The unit 36 simulates two adaptive filters, each having two coefficients, so that:

$$y_m(n)=w_{mO}x(n)+w_{ml}x(n-1)$$

describes the relation between the output sequence $y_m(n)$ to a loudspeaker and the reference signal x(n), where the coefficients are $w_{mO}$ and $w_{ml}$. Hence with the two loudspeakers 37$_1$ and 37$_2$:

$$y_1(n)=w_{10}x(n)+w_{11}x(n-1)$$

and $$y_2(n)=w_{20}x(n)+w_{21}x(n-1).$$

The values of the coefficients $w_{m0}$ and $w_{m1}$ are calculated by the unit 36 from the relationship:-

$$w_{mi}(n+1) = w_{mi}(n) + \alpha \sum_{l=1}^{4} e_l(n)r_{lm}(n-i)$$

in which $\alpha$ is a fixed convergence coefficient, $r_{lm}(n-i)$ is a value of a filtered reference signal $r_{lm}$, and i=0 or 1.

The filtered reference signal $r_{lm}$ is a sequence formed by filtering the reference signal x(n) with a filter that models the effect of the acoustic coupling between the $m^{th}$ loudspeaker and the $l^{th}$ microphone. The unit 36 simulates this filtering as digital FIR (Finite Impulse Response) filtering. Coefficients for the digital FIR filtering are adjusted adaptively during an initialisation program in which a white noise generator 48 is energised.

In the initialisation program, a white noise signal is generated by the generator 48, which is then filtered by a low pass filter 49 to prevent aliasing, the filter 49 having a cut-off frequency of 460 Hz. The signal is subsequently sampled and converted by an analog to digital converter 50. The digital output of the converter 50 is used to drive the loudspeakers 37$_1$ and 37$_2$, by way of the processor and memory unit 36, and the resulting digital input to the unit 36 from the microphones 42$_1$, 42$_2$, 42$_3$ and 42$_4$ is used to determine the values of reference filter coefficients $c_{lmj}$ where j=0, . . . , 34. The unit 36 performs a 35 coefficient FIR modelling of the impulse response between the $m^{th}$ loudspeaker and the $l^{th}$ microphone at the $j^{th}$ sample. Such modelling is described in "Adaptive Signal Processing" by B. Widrow and S. D. Stearns, published in 1985 by Prentice Hall.

The filtered reference sequence is then given by:

$$r_{lm}(n) = \sum_{j=0}^{34} c_{lmj}x(n-j).$$

The operation of the unit 36 is such that, having obtained the error samples $e_l(n)$ and the filtered reference signal $r_{lm}(n)$, each adaptive filter coefficient $w_{mi}$ for each output $y_m(n)$ is updated by a quantity proportional to the sum of the computed products of $e_l(n)$ and $r_{lm}(n-i)$ in accordance with the equation:-

$$w_{mi}(n+1) = w_{mi}(n) + \alpha \sum_{l=1}^{4} e_l(n)r_{lm}(n-i)$$

The new set of adaptive coefficients $w_{mi}$ is then stored and used to filter the next sample of the reference signal, x(n+1).

The unit 36 includes RAM for temporary storage and computation, and EPROM for program storage. Calculated coefficients $w_{mi}$ and $c_{lmj}$, and reference sequences $r_{lm}(n)$ are held in RAM. The convergence coefficient is entered at a set of manually operable switches (not shown).

Preferably the unit 36 includes a Texas Instruments TMS 32010 microprocessor. The input signal rate from the ignition circuit, including the low tension coil 31, is 100 Hz to 200 Hz, and the waveform shaper 33 is a monostable circuit triggered by the leading edge of the input signal to produce pulses of a constant width which is small relative to the sample period set by the sample rate of 1.2 kilohertz. The low pass filters 39, 44 and 49 are active filter modules supplied by Kemo Limited under No. 1431/L.

Only a small amount of separate additional RAM is required with the above-mentioned TMS 32010 microprocessor, which has considerable internal RAM and operates as described in the TMS 32010 Users' Guide published in 1983 by Texas Instruments Inc. Data buses between the unit 36 and the converters 35, 41, 46 and 50 are 12 bit buses. Other buses and lines required for synchronisation and control are omitted for clarity. It will be noted that the values of the coefficients $w_{mi}$ and $c_{lmj}$ can be initially set to zero.

A family of algorithms which are alternatives to the SNM algorithm uses a bank of adaptive digital filters working in parallel for each secondary source. Each individual filter is fed by a reference signal containing a subset of the harmonics or subharmonics to be controlled. For example, FIG. 6 of the accompanying drawings shows two parallel FIR filters 70 each fed by pure tone reference signals 71, at the second and fourth engine order frequencies in this case. The outputs 72 of these filters are added together by an adder 73 to form an output 74 to the secondary source. Each of the parallel filters 70 may be updated by any of the algorithms discussed above. For example, the said stochastic gradient algorithm may be modified so that:

$$w_{Imi}(n+1) = w_{Imi}(n) + \alpha \sum_{l=1}^{L} e_l(n)r_{lmI}(n-1)$$

where $w_{Imi}$ is the i'th coefficient of the FIR filter fed from the I'th harmonic of the engine, driving the m'th secondary source.

The advantage of such an algorithm is that each harmonic frequency is controlled independently and the convergence of an harmonic does not couple with the convergence of any other harmonic, as is the case when a 2I coefficient filter is used to filter I harmonics simultaneously. In this case I filters each with 2 coefficients could be used to filter I harmonics individually, and their response combined afterwards. The disadvantage of this algorithm is that a filtered reference signal needs to be generated for each source (m), sensor (l) and harmonic (I), to give each $r_{lmI}(n)$.

Another approach to controlling a number of harmonics is to take the Fourier transform of each of the error signals and to update a set of coefficients controlling each harmonic of each secondary output independently. The outputs of each of these filters are then combined together, for each secondary source, via an inverse Fourier transform, to generate the output waveform for this source, as indicated in FIG. 7.

For a single harmonic in the frequency domain, the complex value of the 'th error signal will be given by $$E_l = A_l + \sum_{m=1}^{M} c_{lm} w_m$$

where $A_l$ is the value of $E_l$ with no active control, $w_m$ is the complex amplitude of the voltage to the m'th secondary source and $c_{lm}$ is the complex transfer function between the l'th sensor and m'th source at the frequency of the harmonic of interest.

This may be expressed in matrix form as:

$$E = A + CW$$

where:

$$E^T = (E_1\ E_2 \ldots E_L)$$
$$A^T = (A_1\ A_2 \ldots A_L)$$
$$W^T = (W_1\ W_2 \ldots W_M)$$

$$C = \begin{pmatrix} C_{11} & C_{12} & \ldots & C_{1M} \\ C_{21} & C_{22} & \ldots & \ldots \\ \cdot & & & \\ \cdot & & & \\ \cdot & & & \\ C_{L1} & \ldots & & C_{LM} \end{pmatrix}$$

The cost function in this case may be written as $J = E^H E$ where the superscript H denotes the complex conjugate of the transposed vector or matrix. Therefore:

$$J = A^H A + W^H C^H A + A^H C W + W^H C^H W$$

Note that $$\therefore \frac{\partial J}{\partial W} = 2C^H A + 2C^H C\ W = 2C^H E$$

so that the steepest descent algorithm may be written:

$$W_{k+1} = W_k - 2\mu C^H E_k$$

where $W_k$ and $E_k$ are the complex values of the filter response and error output respectively at the k'th iteration.

This algorithm does not seem to appear in the active control literature. This is probably because the Newton's method algorithm, below, is no more difficult to implement after initialisation to form the matrix needed to premultiply $E_k$. However, in some cases it may be that the matrix C changes with time and a separate "identification" algorithm is used in parallel with the adaptive control algorithm to track these changes. In such cases the steepest descent algorithm may be considerably more computationally efficient to implement than that below.

The frequency demain version of the Newton's method algorithm may be written:

$$W_{k+1} = W_k - 2\mu(C^H C)^{-1} C^H E_k$$

A special case of this algorithm does appear in the literature, in which the number of error sensors is equal to the number of secondary sources (L=M), so that C is a square matrix, and the algorithm reduces to:

$$W_{k+1} = W_k - 2C^{-1} E_k$$

This algorithm has been presented by Pierce (1985, David W. Taylor Naval Ship Research and Development Center Report No. 85/047. An algorithm for active adaptive control of periodic interface). If the convergence coefficient, $\mu$, is set equal to one half, the algorithm also reduces to the iterative matrix algorithm described in White and Cooper (1984, Applied Acoustics 17, 99-109. "An adaptive controller for multivariable active control"). See also U.K. Patent Specification No. 2,122,052A.

Figure 8:
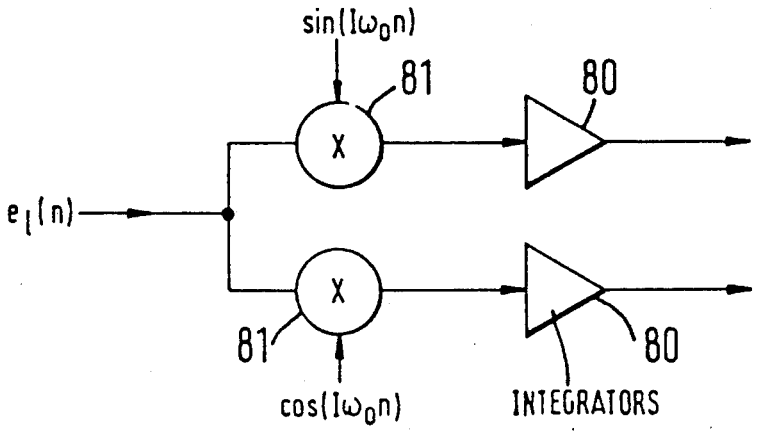
FIG. 8 is a schematic diagram illustrating a heterodyne and averaging method of obtaining inphase and quadrature components of an error sequence in another embodiment of the invention.

In practice the most advantageous algorithm will probably be derived from a judicious mixture of time and frequency domain concepts. For example, one implementation of a Fourier transformer operating on each error sequence $e_l(n)$ to produce the inphase and quadrature frequency components of $e_l(n)$ at $I\omega_o$ is illustrated in FIG. 8 wherein integrators 80 and multipliers 81 are used. The slowly varying outputs of this circuit represent the real and imaginary parts of the frequency domain signal $E_l$ defined above, so these signals can be used with any of the frequency domain algorithms discussed above to update a bank of adaptive filters driven by this frequency component driving each secondary source, as in FIG. 6.

Figure 9:
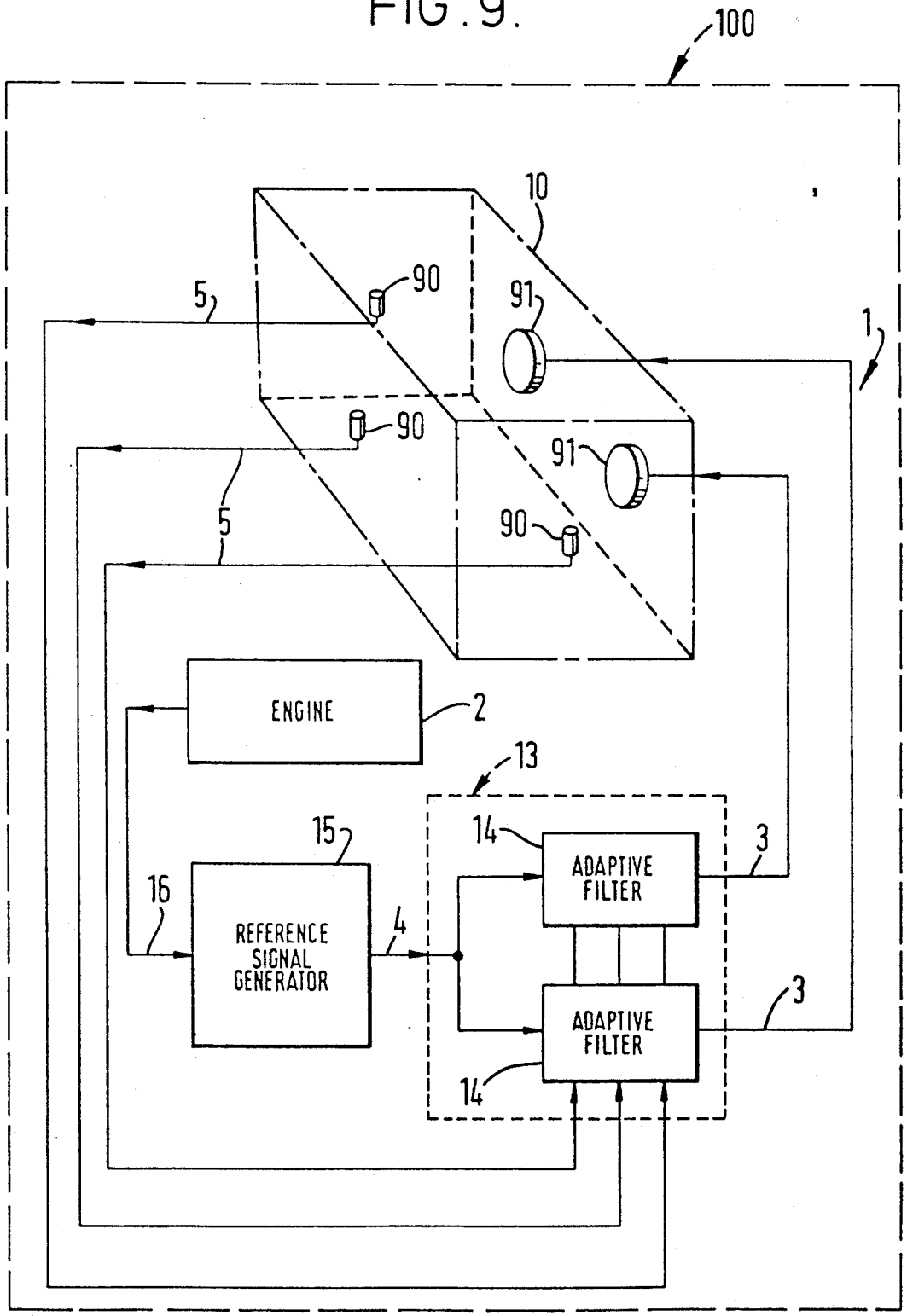
FIG. 9 illustrates application of the invention to non-noise vibration control.

FIG. 9 illustrates application of the invention to non-noise, i.e. mechanical, vibration control.

The example illustrated by FIG. 9 comprises a modification of the FIG. 1 arrangement, wherein the microphone sensors have been replaced by accelerometers 90 and the loudspeakers by mechanical vibrators 91. The accelerometers 90 and vibrators 91 are mounted on surface portions of the enclosure 10.

Figure 10:
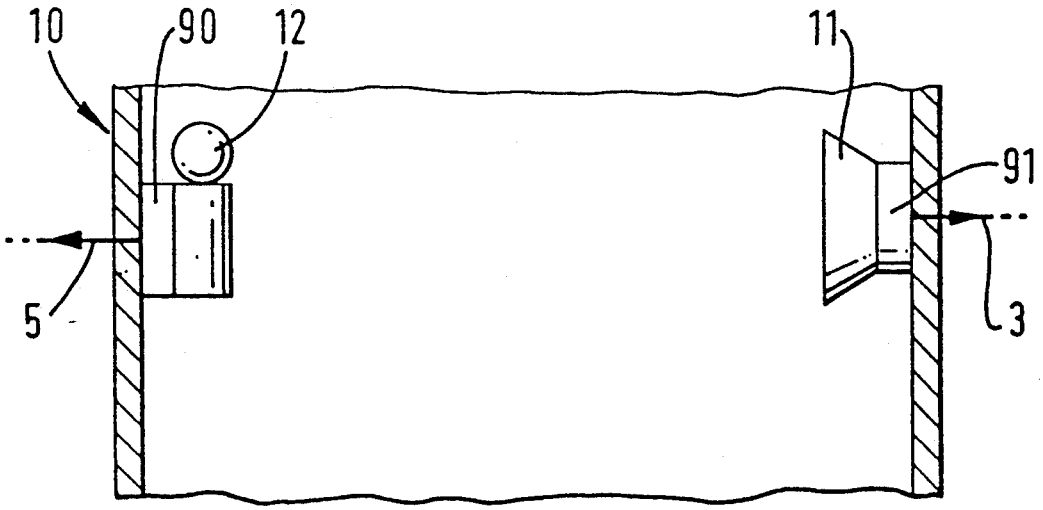
FIG. 10 illustrates a modification of the arrangement shown in FIG. 9.

In another modification, illustrated by FIG. 10, a sensing combination of microphones 12 and accelerometers 90 is used, and/or a source combination of loudspeakers 11 and vibrators 91.

A combination of FIG. 10 need not be coincident; the components thereof could instead be spaced from each other.

We claim:

1. An active vibration control system for reducing, by the generation of secondary vibrations, the vibration generated in a vibration field by a primary source of vibration, comprising a) a processing means having an error signal input, a reference signal input, and a drive signal output;

b) said processing means having means to generate at said drive signal output at least one drive signal in response to a reference signal;

c) a plurality M of spaced-apart secondary vibration sources for generating said secondary vibrations in said vibration field;

d) means to connect said secondary sources to the drive signal output of the processing means, said means including a first low-pass filter means provided for filtering said at least one drive signal output from said processing means, said first low pass filter means having a fixed cut-off frequency;

e) reference signal generating means responsive to said primary source to generate at least one reference signal representing at least one selected harmonic of said primary source of vibration;

f) means to connect said reference signal generating means to the reference signal input of the processor means;

g) a plurality L, L>M, of spaced apart sensor means at a plurality of locations in said vibration field by said primary and secondary sources, and operative to output error signals in response to detection of vibrations from said primary and secondary sources;

h) means to connect said sensor means with said error signal input of said processing means, said means including a second low-pass filter means provided for filtering said error signals input to said processing means, said second low-pass filter means having a fixed cut-off frequency;

i) a sample rate oscillator for providing a constant sample rate signal;

j) means to supply said sample rate signal to said processing means to enable said processing means to sample the reference and error signals at a constant sampling rate;

k) said processing means comprising a plurality of adaptive response filters having first filter coefficients and second filter coefficients, I) said first filter coefficients to model the phase and amplitude response of said sensor means to the output of said secondary vibration sources over a wide range of frequencies, II) said second filter coefficients being determined in accordance with an algorithm in response to the sampled values of the error signals as filtered by said second low-pass filter means; and l) said processing means being operative to provide said drive signal, using said first and second filter coefficients, to reduce the amplitude of vibrations sensed by said sensor means.

2. An active vibration control system as claimed in claim 1 wherein said reference signal generating means is operative to supply a reference signal representing at least two harmonics of said primary source of vibration to said processing means.

3. An active vibration control system as claimed in claim 1, including an array of adaptive response filters each having 35 first coefficients ($C_{lmj}$) which model the response of said sensor means to at least one output of said secondary vibration sources.

4. An active vibration control system as claimed in claim 1, including a number I of adaptive filters each having two second filter coefficients ($w_{mi}$), where I is the number of harmonics in said reference signal.

5. An active vibration control system as claimed in claim 1, wherein said adaptive response filters are provided with a plurality of reference signals each representing a single harmonic, said filters having their outputs combined to form an output to said secondary sources and being independently adjustable.

6. An active vibration control system as claimed in claim 1, including an array of adaptive response filters operative to take the Fourier transform of said error signals, update a set of complex second coefficients ($W_k$) for said array of filters which control each harmonic of said drive signal, and combine outputs of said array of filters via an inverse Fourier transform to generate said drive signal.

7. An active vibration control system as claimed in claim 1, wherein said reference signal generating means includes a reference signal filter for filtering a periodic input signal having its fundamental frequency locked to a predominant frequency of said primary source of vibration.

8. An active vibration control system as claimed in claim 7, wherein said reference signal filter comprises a tracking filter.

9. An active vibration control system as claimed in claim 1, wherein said reference signal generating means includes at least one tunable oscillator, the frequency thereof being controlled by a signal indicative of the fundamental frequency of said primary source of vibration.

10. An active vibration control system as claimed in claim 1, including an array of adaptive response filters each having a plurality of said first coefficients ($C_{lmj}$) which are adjusted adaptively during an initialisation phase of operation of said system.

11. An active vibration control system as claimed in claim 1, including an array of adaptive response filters each having a plurality of said first coefficients ($C_{lmj}$) which are adjusted adaptively during the operation of said system by feeding training signals over a wide frequency range to each secondary source, which signals are suitably uncorrelated with each other and with the primary source of vibration.

12. An active vibration control system as claimed in claim 1, wherein said adaptive response filters are operative to adjust said drive signal in accordance with an algorithm so as to substantially minimise a cost function on a time scale comparable with delays associated with the propagation of vibration from said secondary vibration sources to said sensor means.

13. An active vibration control system as claimed in claim 12, wherein said adaptive response filters are operative to adjust said drive signal in accordance with a time domain stochastic gradient algorithm of the form:

$$w(n+1)=w(n)-2\mu R^T(n)e(n).$$

where w(n+1) represents a vector of values of the second filter coefficients for the $(n+1)^{th}$ sample;

w(n) represents a vector of values of the second filter coefficients for the $n^{th}$ sample;

$\mu$ represents a convergence factor;

$R^T(n)$ represents a transposed matrix of signals obtained by filtering said reference signal using said first filter coefficients; and e(n) represents a vector of values of the error signals for the $n^{th}$ sample.

14. An active vibration control system as claimed in claim 13, wherein said adaptive response filters are operative to adjust said drive signal in accordance with a Newton's method algorithm of the form:

$$W_{k+1}=W_k-2\mu E([R^T(n)R(n)])^{-1}E(R^T(n)e(n))$$

where $W_{k+1}$ represents a vector of complex values of the filter response at the $(k+1)^{th}$ iteration;

$W_k$ represents a vector of complex values of the filter response at the $k^{th}$ iteration;

$\mu$ represents a convergence factor;

E represents the expectation of the term in the brackets;

$R^T(n)$ represents a transposed matrix of signals obtained by filtering said reference signal using said first filter coefficients;

R(n) represents a matrix of signals obtained by filtering said reference signal using said first filter coefficients; and e(n) represents a vector of values of the error signals for the $n^{th}$ sample.

15. An active vibration control system as claimed in claim 13, wherein said adaptive response filters are operative to adjust said drive signal at a single harmonic in accordance with a Newton's method algorithm of the form:

$$W_{k+1}=W_k-2\mu(C^HC)^{-1}C^HE_k.$$

where $W_{k+1}$ represents a vector of complex values of the filter response at the $(k+1)^{th}$ iteration;

$W_k$ represents a vector of complex values of the filter response at the $k^{th}$ iteration;

$\mu$ represents a convergence factor;

C represents the matrix of transfer functions;

$E_k$ represents a vector of complex values of the Fourier transform of the error signals at the $k^{th}$ iteration; and H denotes the complex conjugate of the transposed vector or matrix.

16. An active vibration control system as claimed in claim 12, wherein said adaptive response filters are operative to adjust said drive signal in accordance with stochastic Newton's method algorithm of the form:

$$w(n+1)=w(n)-2\mu Q^T(n)e(n).$$

where w(n+1) represents a vector of values of the second filter coefficients for the $(n+1)^{th}$ sample;

w(n) represents a vector of values for the filter coefficients for the $n^{th}$ sample;

$\mu$ represents a convergence factor;

$Q^T(n)$ represents a modified matrix of filtered reference signals; and e(n) represents the complex values for the error signals for the $n^{th}$ sample.

17. An active vibration control system as claimed in claim 12, wherein said adaptive response filters are operative to adjust said drive signal at a single harmonic in accordance with a steepest descent algorithm of the form:

$$W_{k+1}=W_k-2\mu C^HE_k$$

where $W_{k+1}$ represents a vector of complex values of the filter response at the $(k+1)^{th}$ iteration;

$W_k$ represents a vector of complex values of the filter response at the $k^{th}$ iteration;

$\mu$ represents a convergence factor;

$E_k$ represents a vector of complex values of the Fourier transform of the error signals at the $k^{th}$ iteration;

C represents the matrix of transfer functions; and

H denotes the complex conjugate of the transposed vector or matrix.

18. An active vibration control system as claimed in claim 1, wherein said secondary vibration sources comprise loudspeakers, and said sensor means comprises microphones.

19. An internal combustion engine driven vehicle including the active vibration control system of claim 18, wherein said loudspeakers comprise loudspeakers of a stereo audio system fitted to said vehicle.

20. An active vibration control system as claimed in claim 1, wherein said secondary vibration sources comprise vibrators, and said sensor means comprises accelerometers.

21. An active vibration control system as claimed in claim 1, wherein said secondary vibration sources comprise a mix of loudspeakers and vibrators and said sensor means comprise a mix of microphones and accelerometers.

22. An internal combustion engine driven vehicle including the active vibration control system of claim 1.

23. An active vibration control system for reducing, by the generation of secondary vibrations, the vibration generated in a vibration field by a primary source of vibration, comprising a) a processing means having an error signal input, a reference signal input, and a drive signal output;

b) said processing means having means to generate at said drive signal output at least one drive signal in response to a reference signal;

c) a plurality M of spaced-apart secondary vibration sources for generating said secondary vibrations in said vibration field;

d) means to connect said secondary sources to the drive signal output of the processing means, said means including a first low-pass filter means provided for filtering said at least one drive signal output from said processing means, said first low pass filter means having a fixed cut-off frequency;

e) reference signal generating means responsive to said primary source to generate at least one reference signal representing at least one selected harmonic of said primary source of vibration;

f) means to connect said reference signal generating means to the reference signal input of the processor means;

g) a plurality L, of spaced apart sensor means at a plurality of locations in said vibration field generated by said primary and secondary sources, and operative to output error signals in response to detection of vibrations from said primary and secondary sources;

h) means to connect said sensor means with said error signal input of said processing means, said means including a second low-pass filter means provided for filtering said error signals input to said processing means, said second low-pass filter means having a fixed cut-off frequency;

i) a sample rate oscillator for providing a constant sample rate signal;

j) means to supply said sample rate signal to said processing means to enable said processing means to sample the reference and error signals at a constant sampling rate;

k) said processing means comprising a plurality of adaptive response filters having first filter coefficients and second filter coefficients, I) said first filter coefficients to model the phase and amplitude response of said sensor means to the output of said secondary vibration sources over a wide range of frequencies, II) said second filter coefficients being determined in accordance with an algorithm in response to the sampled values of the error signals as filtered by said second low-pass filter means, said algorithm being arranged to minimise a cost function; and l) said processing means being operative to provide said drive signal, using said first and second filter coefficients, to reduce the amplitude of vibrations sensed by said sensor means.

* * * * *